US009790951B2

(12) United States Patent
Lin et al.

(10) Patent No.: US 9,790,951 B2
(45) Date of Patent: Oct. 17, 2017

(54) SHAFTLESS FAN STRUCTURE

(71) Applicant: Cooler Master (Kunshan) Co., Ltd., KunShan, JiangSu (CN)

(72) Inventors: Fu-Lung Lin, KunShan (CN); Hui-Hai Yang, KunShan (CN); Tong-Xian Chen, KunShan (CN)

(73) Assignee: COOLER MASTER (KUNSHAN) CO., LTD., Kunshan (CN)

( * ) Notice: Subject to any disclaimer, the term of this patent is extended or adjusted under 35 U.S.C. 154(b) by 179 days.

(21) Appl. No.: 14/642,491

(22) Filed: Mar. 9, 2015

(65) Prior Publication Data

US 2016/0010653 A1 Jan. 14, 2016

(30) Foreign Application Priority Data

Jul. 10, 2014 (CN) ..... 2014 2 0381086 U

(51) Int. Cl.

| | |
|---|---|
| ***F04D 29/059*** | (2006.01) |
| ***F04D 29/28*** | (2006.01) |
| ***F04D 25/06*** | (2006.01) |
| ***F04D 17/16*** | (2006.01) |

(52) U.S. Cl.

CPC ..... *F04D 29/059* (2013.01); *F04D 17/16* (2013.01); *F04D 25/062* (2013.01); *F04D 25/0613* (2013.01); *F04D 29/281* (2013.01)

(58) Field of Classification Search

CPC ..... F04D 29/059; F04D 29/281; F04D 17/16; F04D 25/0613; F04D 29/186; F04D 29/601; F04D 19/002; H02K 5/1677; H02K 5/1737

See application file for complete search history.

(56) References Cited

U.S. PATENT DOCUMENTS

| | | | | |
|---|---|---|---|---|
| 5,947,704 | A * | 9/1999 | Hsieh | F04D 29/059 417/423.12 |
| 2006/0119198 | A1* | 6/2006 | Chio | H02K 7/09 310/90.5 |
| 2011/0255999 | A1* | 10/2011 | Adamietz | F01C 21/02 417/65 |
| 2013/0121829 | A1* | 5/2013 | Liu | F04D 29/056 416/174 |
| 2013/0259666 | A1* | 10/2013 | Wong | F04D 19/002 415/183 |

* cited by examiner

*Primary Examiner* — Nathaniel Wiehe
*Assistant Examiner* — Elton Wong
(74) *Attorney, Agent, or Firm* — Maschoff Brennan

(57) ABSTRACT

A shaftless fan includes a fan stator, a vane rotor and a rolling bearing. The rolling bearing is installed between the fan stator and the vane rotor and includes an inner ring, an outer ring, and a plurality of rolling elements rollably installed between the inner and outer rings, and the inner and outer rings of the rolling bearing are rotated in opposite direction with respect to each other, so that the vane rotor can be rotated on the fan stator to connect the fan stator with the vane rotor through the rolling bearing, so as to achieve the shaftless effect.

13 Claims, 3 Drawing Sheets

SHAFTLESS FAN STRUCTURE

FIELD OF THE INVENTION

The technical field of the present invention relates to fans, and more particularly to the fan with a shaftless structure.

BACKGROUND OF THE INVENTION

In the technological advancement we are experiencing in the computer industry today, fans have become one of the necessary heat dissipating components of a computer. Besides the heat dissipation requirement, a fan is designed with thin and light features to fit the computers or other 3C products, so that fans are restricted by space and volume, and even weight is a factor that must be taken into consideration for the design.

However, the conventional cooling fan must come with a stator and a rotor, wherein the rotor is a fan vane, and a general vane is comprised of an impeller and a plurality of blades installed outside the impeller, and a magnetic element is installed in the impeller and provided for having an electromagnetic induction with the stator. In addition, a shaft is installed at the center of the impeller, and a sleeve is provided for the pivotal installation, so that there is an issue of wearing between the shaft and the sleeve, which affects the service life of the product. Since most components of the conventional vane include the shaft and sleeve, therefore the structure of the fan has not been simplified to achieve the lightweight effect, and the conventional fan requires further improvements.

In view of the aforementioned drawbacks of the prior art, the inventor of the present invention based on years of experience in the related industry to conduct extensive researches and experiments, and finally designed a feasible solution to overcome the drawbacks of the prior art.

SUMMARY OF THE INVENTION

Therefore, it is a primary objective of the present invention to provide a shaftless fan structure that connects a stator with a rotor of a fan through a rolling bearing to achieve the shaftless effect.

Another objective of the present invention is to provide a shaftless fan structure that achieves the effects of simplifying the components, lowering the cost, and reducing the thickness of the fan, since there is no shaft, and naturally has no problem of wearing out the shaft or requiring continuous lubrications of the bearing.

To achieve the aforementioned and other objectives, the present invention provides a shaftless fan structure, comprising: a fan stator; a vane rotor; and a rolling bearing, installed between the fan stator and the vane rotor, and the rolling bearing includes an inner ring, an outer ring, and a plurality of rolling elements rollably installed between the inner and outer rings, and the inner and outer rings are rotated in opposite directions with respect to each other, so that the vane rotor can be rotated on the fan stator.

In the aforementioned shaftless fan structure, the vane rotor includes an impeller, a plurality of blades disposed outside the impeller, and a magnetic element installed in the impeller, and the impeller has a circular wall, and each blade is arranged around the periphery of the impeller and mounted onto the circular wall.

The aforementioned shaftless fan structure further comprises a hood for mounting the fan stator thereon, and a bearing collar mounted onto the hood and fixed onto the inner ring of the rolling bearing, and the outer ring of the rolling bearing being fixed into the circular wall of the vane rotor.

In the aforementioned shaftless fan structure, the impeller includes a ring portion therein, and the magnetic element is mounted on the internal wall of the ring portion.

The aforementioned shaftless fan structure further comprises a hood, and the fan stator is fixed onto the hood, and the hood includes a bearing collar thereon and fixed onto the outer ring of the rolling bearing, and the inner ring of the rolling bearing is fixed onto the external wall of the ring portion of the vane rotor.

In the aforementioned shaftless fan structure, the impeller is covered onto the exterior of the fan stator, and provided for the fan stator to be accommodated into a space enclosed by the impeller and the circular wall of the impeller.

In the aforementioned shaftless fan structure, the rolling bearing is a ball bearing, a roller bearing or a needle roller bearing.

In the aforementioned shaftless fan structure, the hood is covered onto the exterior of the vane rotor.

In the aforementioned shaftless fan structure, the hood includes a base and a hood cover, and the base includes a fixing part for fixing the fan stator, and the bearing collar is fixed onto the base, and a first vent is formed on a side of the base, and the hood cover is covered onto the base, and the hood cover has a second vent formed opposite to the vane rotor.

In the aforementioned shaftless fan structure, the first vent and the second vent are an air inlet and an air outlet respectively.

Compared with the prior art, the present invention has the following beneficial effects: Since a rolling bearing is provided for connecting the stator with the rotor of the fan to achieve the shaftless effect, therefore the invention can achieve the effects of simplifying the components, lowering the cost, and reducing the thickness of the fan, since there is no shaft, and naturally has no problem of wearing out the shaft or requiring continuous lubrications of the bearing.

Figure 1:
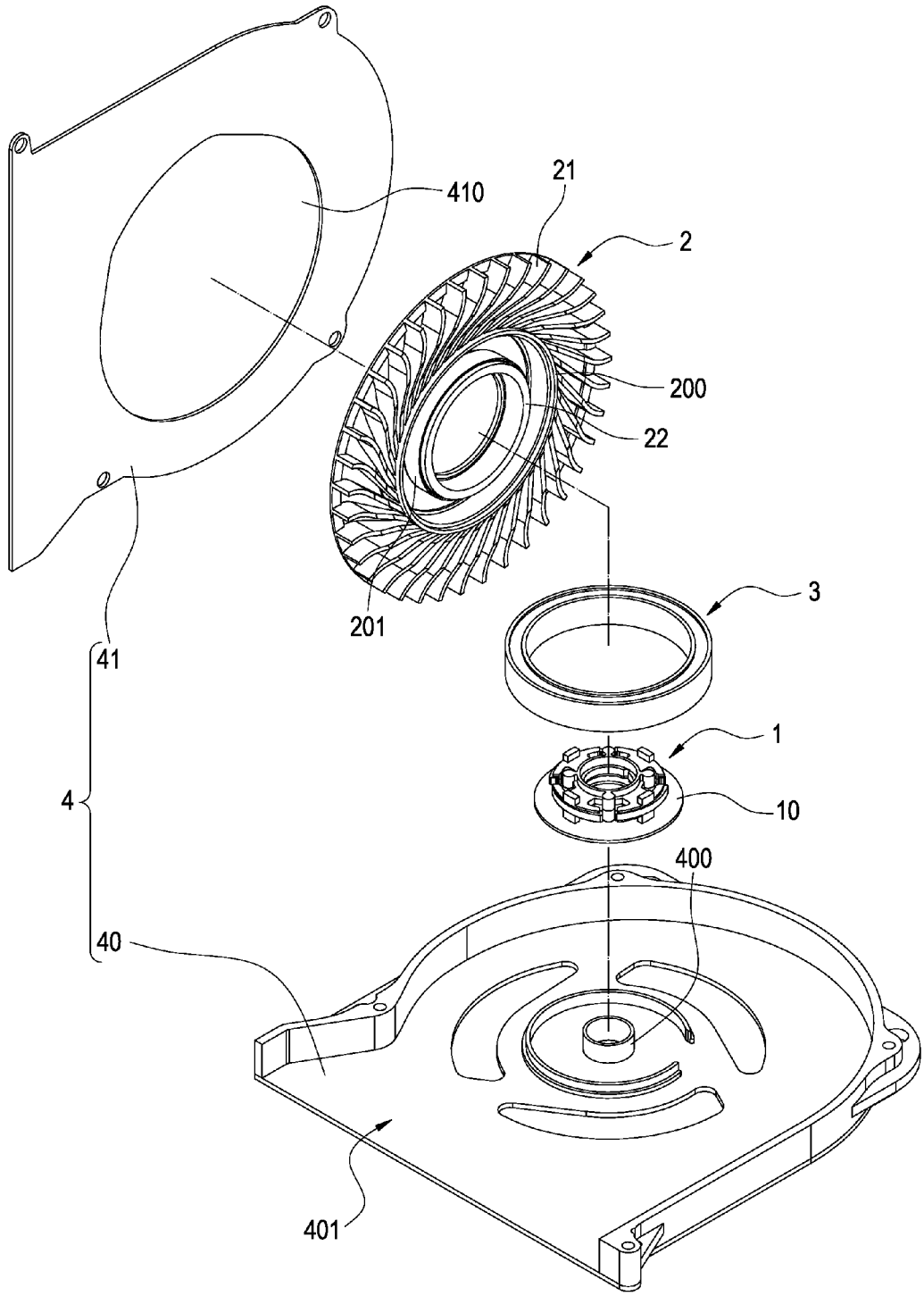
FIG. 1 is an exploded view of a shaftless fan in accordance with a first preferred embodiment of the present invention.

Description of Representative Numerals: Fan stator 1; circuit board 10; bearing collar 100; vane rotor 2; impeller 20; circular wall 200; ring portion 201; blade 21; magnetic element 22; rolling bearing 3; inner ring 30; outer ring 31; rolling element 32; hood 4; base 40; fixing part 400; first vent 401; hood cover 41; second vent 410.

DESCRIPTION OF THE PREFERRED EMBODIMENTS

The technical contents of the present invention will become apparent with the detailed description of preferred embodiments accompanied with the illustration of related drawings as follows. It is noteworthy that same numerals are used for representing same respective elements in the drawings.

Figure 2:
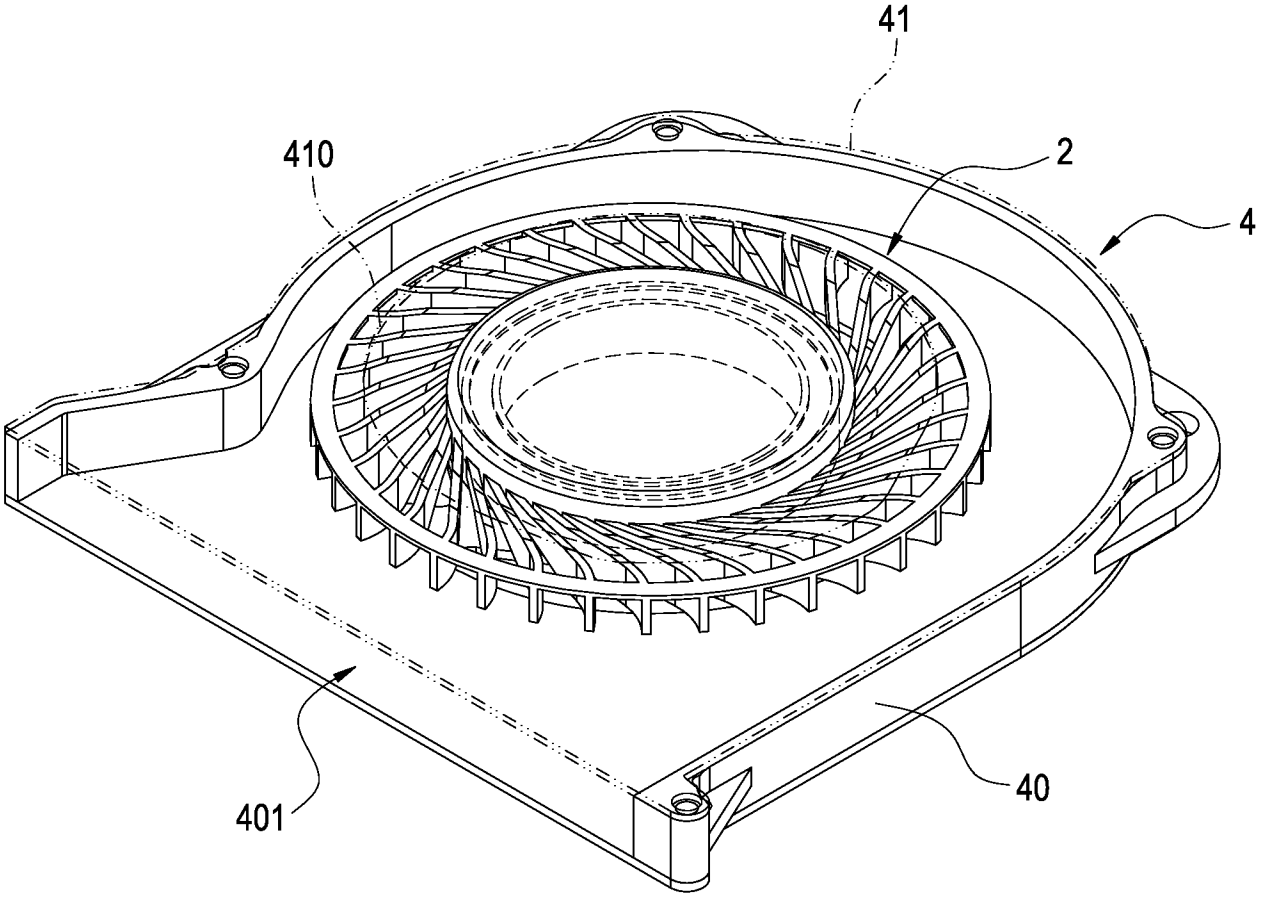
FIG. 2 is a perspective view of a shaftless fan in accordance with the first preferred embodiment of the present invention.
Figure 3:
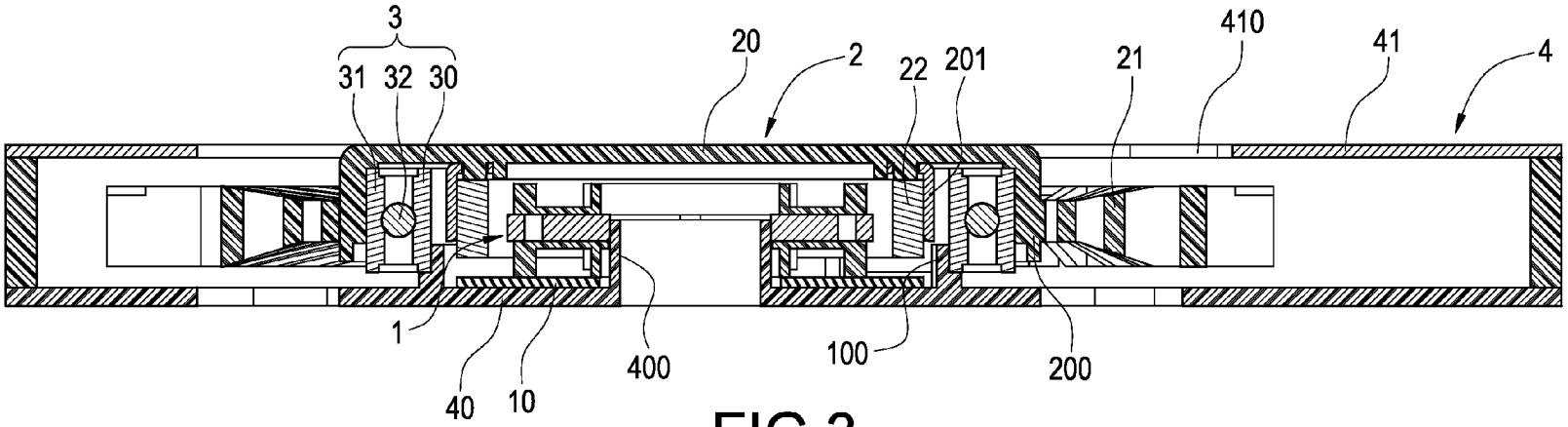
FIG. 3 is a cross-sectional view of a shaftless fan in accordance with the first preferred embodiment of the present invention.

With reference to FIGS. 1, 2 and 3 for an exploded view, a perspective view and a cross-sectional view of a shaftless fan assembly in accordance with the first preferred embodiment of the present invention respectively, the shaftless fan structure comprises a fan stator 1, a vane rotor 2, and a rolling bearing 3.

The fan stator 1 is a motor of the fan and formed by winding a coil around a silicon steel plate, and the fan stator 1 includes a circuit board 10, and the fan stator 1 is installed on the circuit board 10 for an electric connection. The circuit board 10 controls whether or not to electrically conduct the fan stator 1 to produce the electromagnetic effect, so as to drive the vane rotor 2 to rotate.

The vane rotor 2 and the fan stator 1 are installed opposite to each other. The present invention further comprises an impeller 20, a plurality of blades 21 disposed outside the impeller 20, and a magnetic element 22 installed in the impeller 20. The impeller 20 has a circular wall 200, and each blade 21 is arranged around the periphery of the impeller 20 and mounted onto the circular wall 200, and the impeller 20 may be covered onto the exterior of the fan stator 1 and provided for the fan stator 1 to be accommodated into an internal space enclosed by the impeller 20 and a circular wall 200 of the impeller 20 to reduce the thickness of the fan, and the magnetic element 22 and the fan stator 1 can be arranged with an interval apart and opposite to each other (as shown in FIG. 3) to facilitate the electromagnetic induction. To fix the magnetic element 22 into the impeller 20, the impeller 20 may include a ring portion 201 disposed therein, so that the magnetic element 22 can be installed onto an internal wall of the ring portion 201.

The rolling bearing 3 is installed between the fan stator 1 and the vane rotor 2, wherein the rolling bearing 3 may be a ball bearing, a roller bearing or a needle roller bearing used in a general mechanical part, and the rolling bearing 3 includes an inner ring 30, an outer ring 31, and a plurality of rolling elements 32 rollably installed between the inner and outer rings 30, 31. In the first preferred embodiment of the present invention, the fan further includes a hood 4, and the fan stator 1 is fixed onto the hood 4. In other words, the hood 4 and the fan stator 1 are integrally combined, and disposed opposite to the vane rotor 2. In FIG. 3, the hood 4 includes a bearing collar 100, and the bearing collar 100 is fixed onto the inner ring 30 of the rolling bearing 3, and the outer ring 31 of the rolling bearing 3 is fixed into the circular wall 200 of the vane rotor 2, so that the rolling bearing 3 is fixed between the fan stator 1 and the vane rotor 2. When the vane rotor 2 uses the magnetic element 22 and the fan stator 1 for an electromagnetic induction, inner and outer rings 30, 31 of the rolling bearing 3 are rotated in opposite directions with respect to each other, so as to achieve the effect and function of rotating the vane rotor 2 on the fan stator 1 for the operation of the fan.

Further, the hood 4 is covered onto the exterior of the vane rotor 2, and the hood 4 includes a base 40 and a hood cover 41, and the base 40 has a fixing part 400 for fixing the fan stator 1 thereon, and fixing the bearing collar 100 onto the base 40, and a first vent 401 is formed on a side of the base 40, and the hood cover 41 is covered onto the base 40, and a second vent 410 is formed opposite to the vane rotor 2. The first and second vents 401, 410 may be an air inlet and an air outlet respectively, depending on the actual rotating direction of vane rotor 2.

Figure 4:
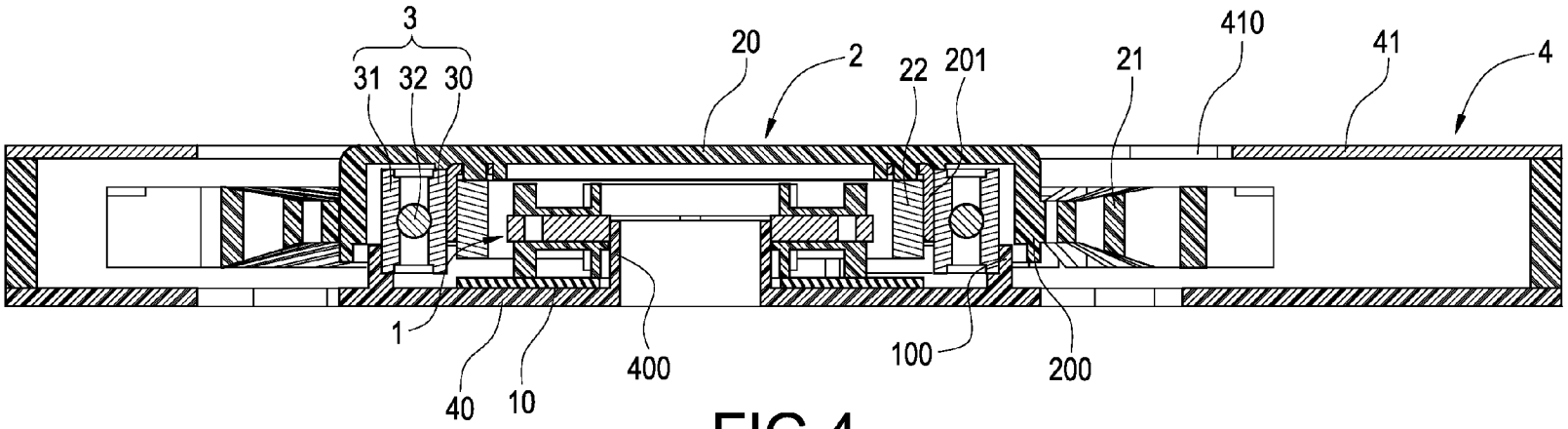
FIG. 4 is a cross-sectional view of a shaftless fan in accordance with a second preferred embodiment of the present invention.

With reference to FIG. 4 for the second preferred embodiment of the present invention, the inner ring 30 of the rolling bearing 3 is fixed onto an external wall of the ring portion 201 of the vane rotor 2, and the bearing collar 100 is fixed onto the outer ring 31 of the rolling bearing 3, so that the rolling bearing 3 can be installed between the fan stator 1 and the vane rotor 2.

With the aforementioned assembly, the shaftless fan structure of the present invention is achieved.

In summation, the rolling bearing 3 connected between the fan stator 1 and the vane rotor 2 in accordance with the shaftless fan structure of the present invention serves as a basis of the shaft required by the rotations of the fan stator 1 and the vane rotor 2 in opposite directions with each other, so that there is no need to use the shaft for the pivotal connection and there is no concern of wearing out the shaft or continuously lubricating the bearing. The present invention achieves the effects of simplifying the components, lowering the cost, and reducing the thickness of the fan.

While the invention has been described by means of specific embodiments, numerous modifications and variations could be made thereto by those skilled in the art without departing from the scope and spirit of the invention set forth in the claims.

What is claimed is:

1. A shaftless fan structure, comprising:

a fan stator;

a vane rotor; and a rolling bearing having a central hollow portion and installed between the fan stator and the vane rotor, and including an inner ring, an outer ring, and a plurality of rolling elements rollably installed between the inner and outer rings; wherein the inner and outer rings are rotated in opposite directions with respect to each other, so that the vane rotor can be rotated on the fan stator, wherein the fan stator is disposed inside the central hollow portion of the rolling bearing;

wherein the vane rotor includes an impeller, a plurality of blades disposed outside the impeller, and a magnetic element installed in the impeller, and the impeller has a circular wall, and each blade is arranged around the periphery of the impeller and mounted onto the circular wall;

wherein the impeller includes a ring portion therein, the ring portion is located between the circular wall and the fan stator, the rolling bearing is located between the ring portion and the circular wall, and the magnetic element is mounted onto an internal wall of the ring portion.

2. The shaftless fan structure of claim 1, further comprising a hood for mounting the fan stator thereon, and a bearing collar mounted onto the hood and fixed onto the inner ring of the rolling bearing, and the outer ring of the rolling bearing being fixed into the circular wall of the vane rotor.

3. The shaftless fan structure of claim 2, wherein the impeller is covered onto the exterior of the fan stator and provided for the fan stator to be accommodated in a space enclosed by the impeller and the circular wall of the impeller.

4. The shaftless fan structure of claim 2, wherein the rolling bearing is a ball bearing, a roller bearing or a needle roller bearing.

5. The shaftless fan structure of claim 2, wherein the hood is covered onto the exterior of the vane rotor.

6. The shaftless fan structure of claim 5, wherein the hood includes a base and a hood cover, and the base includes a fixing part, wherein the fan stator is fixed by the fixing part, and the bearing collar is fixed onto the base, and a first vent is formed on a side of the base, and the hood cover is covered onto the base, and the hood cover has a second vent formed opposite to the vane rotor.

7. The shaftless fan structure of claim 6, wherein the first vent and the second vent are an air inlet and an air outlet respectively.

8. The shaftless fan structure of claim 1, further comprising a hood, and the fan stator being installed on the hood, and the hood having a bearing collar fixed onto the outer ring of the rolling bearing, and the inner ring of the rolling bearing being fixed to an external wall of the ring portion of the vane rotor.

9. The shaftless fan structure of claim 8, wherein the impeller is covered onto the exterior of the fan stator and provided for the fan stator to be accommodated in a space enclosed by the impeller and the circular wall of the impeller.

10. The shaftless fan structure of claim 8, wherein the rolling bearing is a ball bearing, a roller bearing or a needle roller bearing.

11. The shaftless fan structure of claim 8, wherein the hood is covered onto the exterior of the vane rotor.

12. The shaftless fan structure of claim 11, wherein the hood includes a base and a hood cover, and the base has a fixing part fixed thereon, the fan stator is fixed by the fixing part, and the bearing collar is fixed onto the base, and a first vent is formed on a side of the base, and the hood cover is covered onto the base, and the hood cover has a second vent formed opposite to the vane rotor.

13. The shaftless fan structure of claim 12, wherein the first vent and the second vent are an air inlet and an air outlet respectively.

* * * * *